US005547452A

United States Patent [19]

Kepert et al.

[11] Patent Number: 5,547,452

[45] Date of Patent: Aug. 20, 1996

[54] METHOD AND APPARATUS FOR CROSS-FOLDING SIGNATURES

[75] Inventors: Manfred Kepert, Grosskarlbach; Karl H. Zeiler, Bobenheim-Roxheim, both of Germany

[73] Assignee: Albert Frankenthal Aktiengesellschaft, Frankenthal, Germany

[21] Appl. No.: 352,520

[22] Filed: Dec. 9, 1994

[30] Foreign Application Priority Data

Dec. 9, 1993 [DE] Germany ..... 43 42 037.0

[51] Int. Cl.[6] ..... B41F 13/60

[52] U.S. Cl. ..... 493/427; 493/471

[58] Field of Search ..... 270/4, 8, 6, 20.1, 270/21.1, 38, 41, 42, 43, 49, 50; 493/424, 425, 426, 427, 428, 429, 432, 471

[56] References Cited

U.S. PATENT DOCUMENTS

| | | | |
|---|---|---|---|
| 3,870,292 | 3/1975 | Bradley . | |
| 4,036,487 | 7/1977 | Heimlicher | 493/428 |
| 4,666,139 | 5/1987 | Filewich | 493/432 X |
| 4,893,803 | 1/1990 | Petersen | 270/47 |
| 5,035,993 | 7/1991 | Staeb . | |
| 5,057,064 | 10/1991 | Michalik | 493/424 X |
| 5,201,701 | 4/1993 | Roettger et al. | 493/428 X |
| 5,417,642 | 5/1995 | Boronka et al. | 493/427 X |
| 5,429,578 | 7/1995 | Calbrix et al. | 493/429 X |

FOREIGN PATENT DOCUMENTS

| | | |
|---|---|---|
| 0220644 | 5/1987 | European Pat. Off. . |
| 0230305 | 7/1987 | European Pat. Off. . |
| 0570334 | 11/1993 | European Pat. Off. . |
| 2284446 | 4/1976 | France . |
| 536459 | 10/1931 | Germany . |
| 2410943 | 9/1974 | Germany . |
| 3534157 | 4/1987 | Germany . |
| 3512308 | 3/1988 | Germany . |
| 4117205 | 12/1992 | Germany . |

*Primary Examiner*—John E. Ryznic
*Attorney, Agent, or Firm*—Jones, Tullar & Cooper, P.C.

[57] ABSTRACT

A collecting cylinder and a folding flap cylinder cooperate to form a cross-folding device for signatures in a rotary printing press. The leading edge of each signature is initially retained on the collecting cylinder and is held there after insertion of the cylinder into the folding flap. The trailing edge of the signature is transferred to grippers on the folding flap cylinder at a point where the two cylinders are in contact. Operation of the cross-folding device results in reduced folded product damage.

13 Claims, 2 Drawing Sheets

METHOD AND APPARATUS FOR CROSS-FOLDING SIGNATURES

FIELD OF THE INVENTION

The present invention is directed generally to a method and apparatus for cross-folding signatures. More particularly, the present invention is directed to a method and apparatus for cross-folding signatures in a folding apparatus of a rotary printing press. Most specifically, the present invention is directed to a method and apparatus for cross-folding signatures in which the leading edge portions of the signatures are held while the center of the signatures are inserted into the folding flaps of the folding flap cylinder. The leading edges of the signatures are retained on the surface of the collecting cylinder while the trailing edges of the signatures are quickly taken over by the folding flap cylinder. As a center of the signature is inserted by a folding blade into a folding flap, the leading and trailing edges of the signatures are restrained.

DESCRIPTION OF THE PRIOR ART

After a product has been printed in a rotary printing press, it is typically cross-cut into a plurality of signatures. These signatures are then cross-folded by the cooperative actions of a collecting cylinder, which carries a plurality of radially extendable folding blades, and a folding flap or folding groove cylinder that carries a plurality of flaps or grooves into which the transversely folded center of each signature is inserted by one of the folding blades. It is generally known that in the course of forming such a first cross fold in such a signature that there often occurs a so-called whip effect in the resulting folded product. This whip effect occurs in the folded product as it is transferred between a cylinder with folding blades and product handling or gripping devices, and a cylinder with folding flaps and as the folded product is taken over by the folding flap cylinder. This whip effect, with its disadvantageous results, is caused because the first or leading edge of the product being folded, after it has been released by the product holding devices carried by the folding blade cylinder, tends to engage and to push against the second or trailing edge of the folded product. In the process of contact, the first or leading edge of the folded product and its contact with the second or trailing edge of the product creates folded edges, which are referred to as dog ears, and rips, with these rips occurring primarily at the ends of the folded product.

In the course of forming folded products, the first or leading edge of the product to be folded is passed around a guide device that is situated in the outlet wedge formed by the collecting cylinder and the cooperating folding flap cylinder. Such a structure may be seen, for example, in the German Patent Publication No. DE 35 12 308 C. The trailing or second end of the product tends to fan open or is split open after it has left the center area between the collection cylinder with its grippers and folding blades, and the folding flap cylinder. This fanning or splitting open is caused by several factors. On the one hand, the printed product has a tendency to rise up off the surface of the folding blade cylinder and not to rest on the cylinder's circumferential surface after the first cross fold has been made. In addition, the centrifugal force acting on the folded product tends to force the product off the surface of the folding blade cylinder and to give rise to the fanning or splitting open of the product. Such a fanning or splitting open of the product also has a detrimental effect on the quality of the printed product.

The whip effect discussed above is a function of the mass of the printed product and the speed of operation of the press. As the sizes of printed products increases and as the operating speed of the printing presses also goes up, there becomes a greater need to counteract the whip effect problems discussed above. The prior art devices have not been successful in this regard. Thus there is a need for a method and apparatus for cross-folding signatures which will overcome the limitations of the prior art devices.

SUMMARY OF THE INVENTION

It is an object of the present invention to provide a method and apparatus for cross-folding signatures.

Another object of the present invention is to provide a method and apparatus for cross-folding signatures in a folding apparatus of a rotary printing press.

A further object of the present invention is to provide a method and apparatus for cross-folding signatures in which the leading and trailing edge portions of the signatures are restrained during initiation of the folding.

Still another object of the present invention is to provide a method and apparatus for cross-folding signatures which avoids the whip effect damaging of the printed products.

Even yet a further object of the present invention is to provide a method and apparatus for cross-folding signatures in which the uncontrolled splitting or fanning open of the second ends of the signatures during transfer from a collecting cylinder to a folding flap cylinder are avoided.

As will be discussed in greater detail in the description of the preferred embodiment, which is set forth subsequently, the signatures are cross-folded in a cross-folding device which includes a collecting cylinder and a folding flap or groove cylinder. The collecting cylinder has a plurality of signature leading edge grippers and a plurality of folding blades. The folding flap cylinder has a plurality of folding flaps or grooves, and a plurality of signature trailing edge grippers. In accordance with the present invention, the leading edge grippers on the collecting cylinder retain their leading edges after the initial insertion of the center of the signatures into the folding flap. In a similar manner, the trailing edge grippers on the folding flap cylinder take over the trailing edges of the signature as soon after insertion of the signatures center into the folding flap as possible. This take over of the trailing edge occurs generally at a point of intersection of the two cylinders and along an imaginary center line that extends between the axes of rotation of the two cylinders. The second half of each of the signatures is held by gripping devices on the folding flap cylinder that engage the trailing edge of the signatures. The leading edge of the first half of each of the signatures is released from the leading edge grippers on the collecting cylinder when its speed of travel is as close to zero as possible.

The method and apparatus for cross-folding signatures in accordance with the present invention overcomes a number of the limitations of the prior art devices. Splitting or fanning open of the trailing edge of the second half of each one of the signatures is prevented by the securement or holding of the trailing edge of the second half of the signatures on the surface of the folding flap cylinder. This significantly reduces the damaging action of the so-called whip effect and thereby prevents the folding of corners to form dog ears and the ripping of the ends of the folded product. In accordance with the present invention, the grippers which are used to grip the second ends of the folded product are fastened on a separate mounting system. This allows these grippers to be adjusted or shifted to the format of the folding flap system.

The method and apparatus for cross-folding signatures in accordance with the present invention allows the press to operate at a higher speed and with heavier products while reducing the likelihood of damage being done to the printed product. The present invention overcomes the limitations of the prior art and is a substantial advance in the art.

BRIEF DESCRIPTION OF THE DRAWINGS

While the novel features of the method and apparatus for cross-folding signatures in accordance with the present invention will be set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENT

Figure 1:
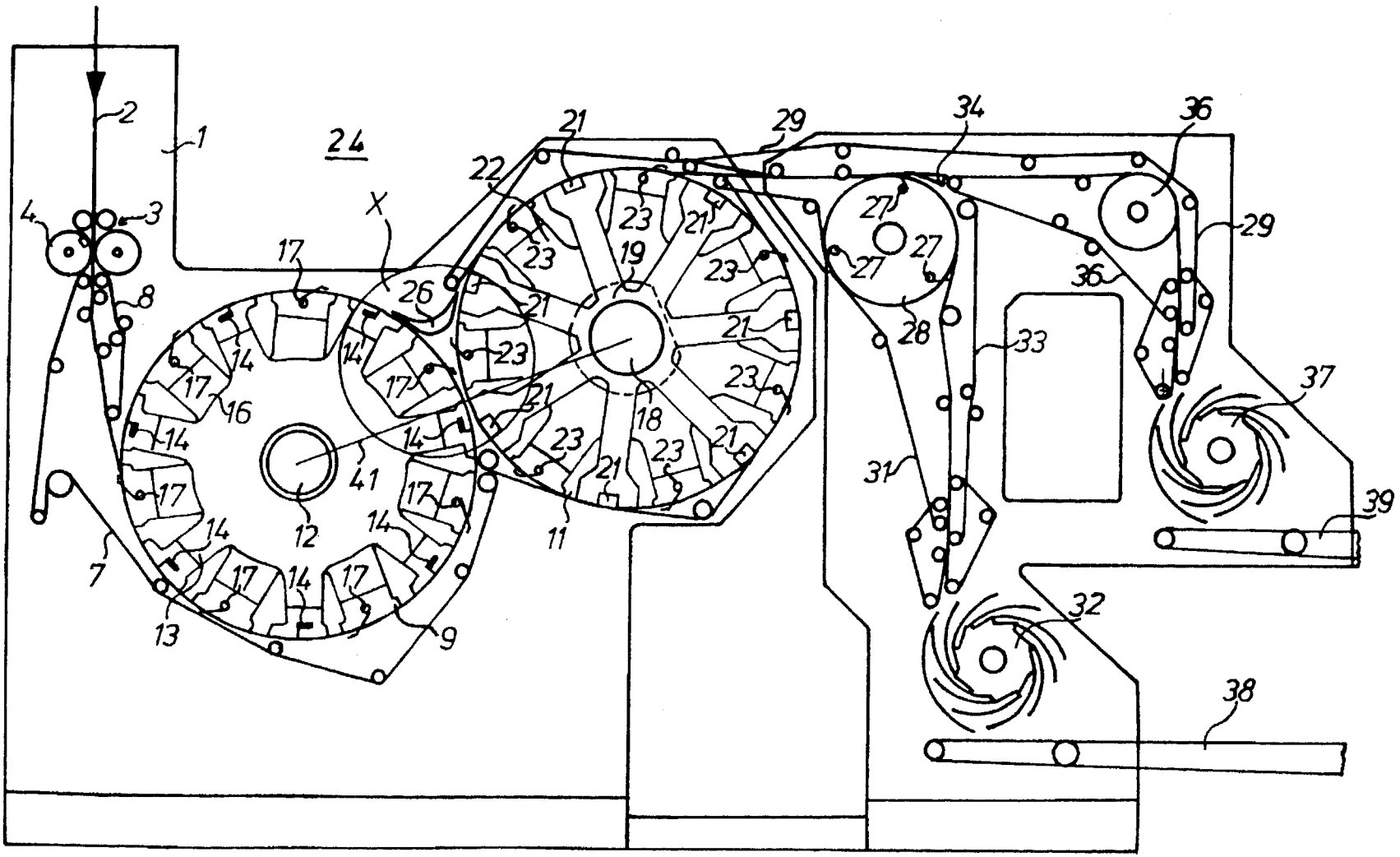
FIG. 1 is a schematic side elevation view of a folding apparatus with a cross-folding device in accordance with a preferred embodiment of the present invention.

Referring initially to FIG. 1, there may be seen a preferred embodiment of a cross-folding device in accordance with the present invention, generally at 24. The cross-folding apparatus is a part of a generally known folder which is depicted somewhat schematically in FIG. 1. It will be understood that the folding apparatus shown in FIG. 1 is part of a generally known rotary printing press which operates in it normal manner and which forms no part of the present invention.

As may be seen by referring to FIG. 1, the folding apparatus, as shown, has two side frames, which are disposed parallel to each other for receiving cylinders. Only one side frame 1 is represented in FIG. 1. A paper web train 2 runs through a pair of drawing rollers 3 and then through a cross-cutting device that is formed by a cross-cutting cylinder 4 and a cutting groove cylinder 6. The signatures, not shown in FIG. 1, which are cut by the cross-cutting device 4, 6 from the paper web 2 are accelerated between two known cooperating conveyor guide systems 7 and 8. The second conveyor guide system 8 extends only as far as the periphery of a subsequently positioned seven-part or seven field collecting cylinder 9. The first conveyor guide system 7 extends in the direction of production and travel of the signatures and is positioned adjacent and against the circumference of the collecting cylinder 9. This conveyor guide system 7 extends as far as an inlet wedge formed by the collecting cylinder 9 and a cooperating seven-part or seven field folding flap cylinder 11. In a preferred embodiment, the collecting cylinder 9 is rotatably supported by a shaft 12 and has on this shaft 12 a first star-shaped support 13 that support seven folding blades, respectively identified by 14, on its circumference. A second star-shaped, seven-armed support 16 is also located on the shaft 12 and supports seven grippers, respectively identified by 17, on its circumference. The grippers 17 are respectively located between the folding blades 14. The first and second star-shaped supports 13 and 16 are each rotatable on, and are removable from the shaft 12 and can also be clamped in place on the shaft 12. They are therefore disposed in a pivotable or shiftable manner with respect to each other on the shaft 12 of the seven field collecting cylinder in accordance with the present invention.

In the preferred embodiment of the invention, the folding flap or jaw cylinder 11 is rotatably supported on a shaft 18 and also has a first star-shaped seven-armed support 19 on its shaft 18, which supports seven folding flaps or jaws, respectively identified by 21 on its circumference. A second seven-armed star-shaped support 22 is also supported by shaft 18. This second support 22 has a plurality of grippers or holding devices, respectively identified by 23, positioned in hollows or channels 25 on its circumference. The supports 19 and 22 are each rotatable on, and are removably supported on the shaft 18 and can be clamped thereto. These two supports 19 and 22 are therefore pivotable or shiftable with respect to each other on the shaft 18.

A product guide device 26 is disposed fixed on the side frame at the outlet wedge of the two cylinders 9 and 11 which cooperate to form a cross-folding device 24, which includes the plurality of elements 13, 16, 19 and 22 that are in the shape of arcs of a circle and which are disposed respectively parallel to each other at a distance on their shafts 12 and 18. A gripper cylinder 28, which is provided with three gripper systems 27, is disposed downstream of the cross-folding device 24 in the moving direction of the products. The folded products, not shown, are directed to gripper cylinder 28 by a folded product conveyor guide system 29, which cooperates with a conveyor guide system 31 which encloses the gripper cylinder 28 and continues in the direction of a first spider wheel or fan wheel 32. The portion of the conveyor guide system 31 pointing in the direction of the spider wheel or fan wheel 32 cooperates with a subsequent conveyor guide system 33. The folded products can be alternatively directed to a second spider wheel or fan wheel 37 by means of a shunt 34 over a deflection roller 36 by the continuing folded product conveyor guide system 29 and by means of a conveyor guide system 36 extending parallel to it. Further conveyor guide systems, which are not depicted in detail, are disposed upstream of the spider wheels 32 and 37. The spider wheels 32 and 37 respectively transfer their folded products to schematically depicted first and second cross-folding delivery conveyors 38 and 39. A binding cylinder, not shown, can be assigned to the collecting cylinder 9 and can be located below the collecting cylinder 9 in the area of the conveyor guide system 7. A straight line, which will be referred to as a center line, and which connects the axes of rotation of the shafts 12, 18 of the cylinders 9, 11 is indicated at 41 in FIGS. 1 and 2.

Figure 2:
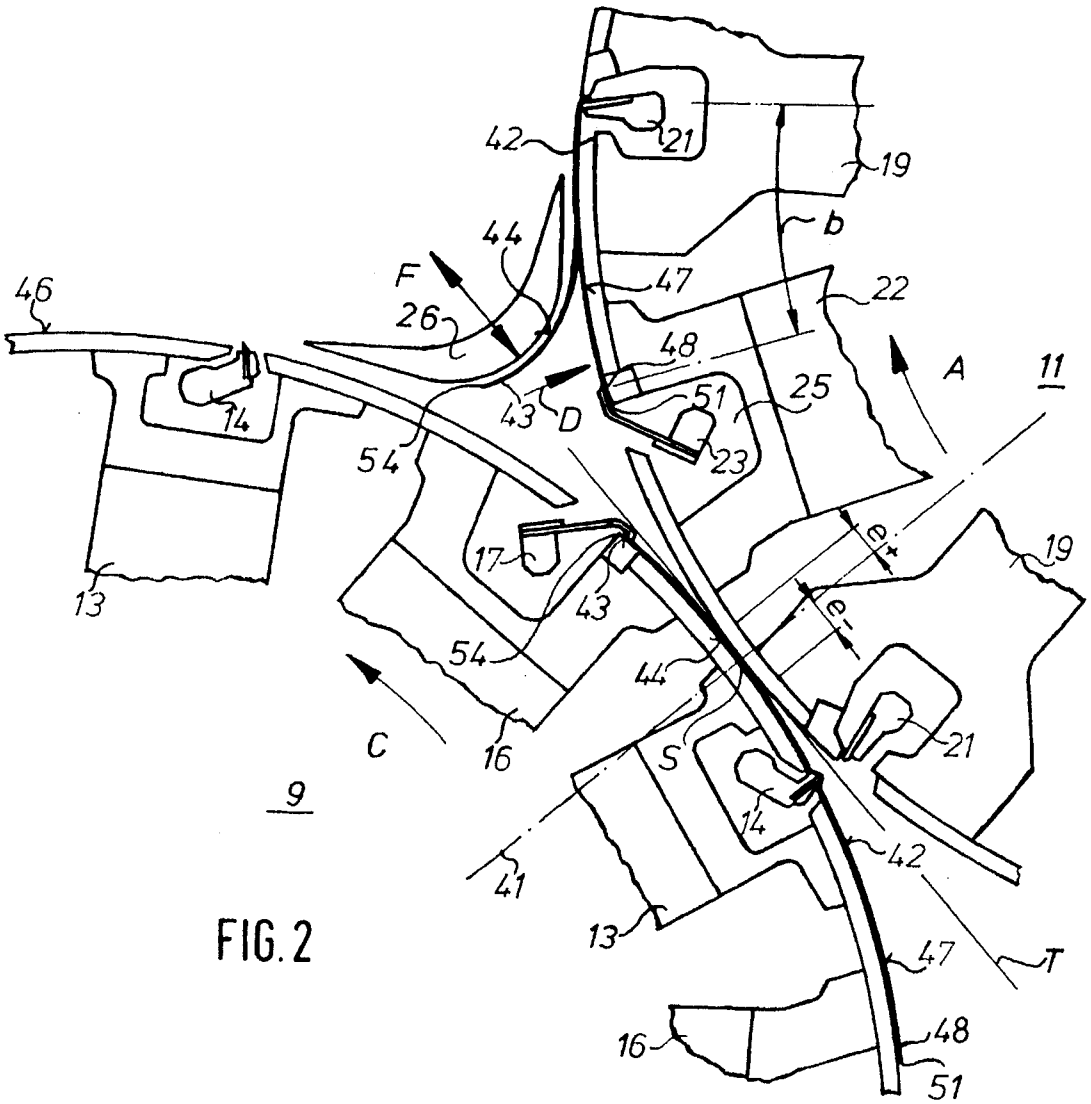
FIG. 2 is an enlarged view of the portion of the cross-folding device encircled at X in FIG. 1.

Turning now to the enlarged depiction of a portion of the cross-folding device 24 in accordance with the present invention, as is shown primarily in FIG. 2, it will be seen that the folding flap cylinder 11, which is turning in a clockwise direction A, has a plurality of generally known controllable grippers 23 each of which is situated at a distance "b", viewed in this direction of rotation A, behind the folding flaps 21 of the folding flap cylinder. In this instance the distance "b" is a curved or arcuate distance between the clamping surface of a folding flap 21 and the support of each of the grippers 23. An unfolded signature 42 is shown on the collecting cylinder 9 which is shown as turning in the counterclockwise direction C in FIG. 2. This signature 42 has a starting area 43 which is provided with a leading or front edge 54. This starting area 42 is part of a first or leading half 44 of the signature 42. This front edge 54 is initially held by the grippers 17 on the jacket surface 46 of the collecting cylinder 9 when the signature 42 is received from conveyor guides 7 and 8. A second or trailing half 47 of the signature 42 starts, viewed in the direction of rotation C, behind the folding blades 14. An end 48 of the trailing half 47 of the signature 42 rests on the jacket surface 46 of the collecting cylinder 9. The first half 44 of the signature 42, even after the signature's center has been gripped by the folding flaps 21 of the folding flap cylinder 11, still rests against the product guide device 26. The signature also will subsequently be held by grippers 23 located on the folding flap cylinder 11 in the end area 48 of its second trailing half 47 after its center has been inserted into the folding flap 21. Fanning or splitting open of the second half 47 is prevented by holding its end area 48 in place on the folding flap cylinder 11 by use of the trailing edge grippers 23.

The curve-shaped distance "b" between the folding flaps 21 and the grippers 23 can be adjusted by shifting the supports 19 and 22 with respect to each other on their shaft 18, so that the production length of the signatures 42 can be designed to be variable, The star-shaped supports 13 and 16 of the collecting cylinder 9 can also be adjusted with respect to each other on their shaft 12.

The cross-folding device 24 in accordance with the present invention, and which includes the collecting cylinder 9 and the folding flap cylinder 11, can be advantageously employed in high-speed folding apparatus for folding magazine products or catalogue products. The folding flap cylinder 11 can also be designed as a 6-, 5-, 4- or 3-part folding flap cylinder, which cooperates with a correspondingly designed collecting cylinder 9.

Control of the operation of the grippers 23 and of the folding flaps 21 of the folding flap cylinder 11 takes place in accordance with the rhythm of the transfer of the signatures 42 from the collecting cylinder 9 to the folding flap cylinder 11, particularly following the collection of several signatures on the collecting cylinder 9 by known control devices, such as described in German Patent Publication DE 41 17 205 Al. It is also possible to substitute controllable needles or points in place of the grippers 23.

The method of operation of the cross-folding device to cross fold signatures in accordance with the present invention will now be discussed. A signature 42, which is held on the collecting cylinder 11 in the starting area 43 of a first or leading half 44 of the signature 42 by means of holding devices 17 as seen in FIG. 2, is cross-folded by means of a folding blade 14 which pushes a central portion of the signature 42 into a folding flap 21 of a folding flap cylinder 11. The central portion of signature 42 is held in the folding flaps 21. Subsequently, a second or trailing half 47 of the signature 42 is gripped, as it becomes positioned in the vicinity of the central line or imaginary plane 41 connecting the axes of rotation of the cylinders 9 and 11 by a controllable holding device 23 or 49 on folding flap cylinder 11 and is retained there. As the starting section 43 of the first or leading half 44 of the signature 42 approaches a forward speed of zero or near zero, the leading edge 54 of the signature 42 is released from the holding devices 17 of the collecting cylinder 9, i.e. shortly before the leading edge 44 of the signature 42 is completely tightened, taking into consideration the design of the product guide device 26 as well as its distance from the center line 41. Subsequently, the starting area 43 and the end area 48 of the signature 42 held in the folding flaps 21 will approximately overlap each other, and then subsequently the holding device 23 or 49 will release the trailing second half 47 of the signature 42.

Figure 3:
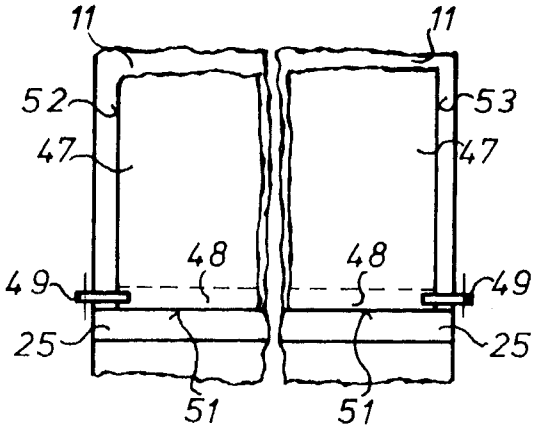
FIG. 3 is a schematic top view, taken in the direction indicated by the arrow D in FIG. 2 and showing a signature second or trailing half and its retention on the folding flap cylinder by grippers which engage the trailing edge of the signature.

The product guide device 26 is adjustable forward or back in the direction of the arrow F with respect to the delivery angle of the cylinders 9 and 11. The starting area 43 of the signature 42 is located on a first or leading half 44 of the signature adjacent the front edge 54 of the signature 42 and is a strip-shaped area extending in a direction parallel to the axes of rotation of the cylinders 9 and 11 in which the grippers 17 maintain the signature 42 on the jacket surface 46 of the collecting cylinder 9. The end area 48 of the second half 47 of the signature 42 is a strip-shaped area that is located adjacent the rear edge 51 of the signature 42 and which extends in a direction parallel to the axes of rotation of the cylinders 9 and 11 and in which the holding devices or grippers 23 or 49 maintain the signature 42 on the jacket of the folding flap cylinder 11. This second or trailing end area 48 of each signature 42 may be seen more clearly by referring to FIG. 3. In the process of the present invention, it is also possible for the controllable holding devices 23 or 49 of the folding flap cylinder 11 to grip the second or trailing half 47 of the signature 42 at a distance "e", of, for example 4 mm, in front of or behind the intersecting point S, viewed in the direction of rotation A of the folding flap cylinder 11 with the collecting cylinder. The point S is on the center line 41 and is where this center line 41 intersects a tangent line T at its point of tangency with the surfaces of the cylinders 9 and 11. The distance "e" can also be zero, so that the trailing half 47 of the signature 42 is gripped by the holding devices 23 or 49 during its passage by the intersecting point S, viewed in the direction of rotation A of the folding flap cylinder 11. It is also possible that the starting area 43 of the first or leading half 44 of the signature 42 will be released by the holding devices 17 of the collecting cylinder 9 at the earliest after the complete penetration of the folding blade 14 into the folding flaps 21 of the folding flap cylinder 11. Controllable grippers 23 or controllable lateral grippers 49 are used as the holding devices 23 or 49.

It is also possible to arrange the pivotable lateral grippers 49 in such a way on the side panels, not shown, outside the folding flap cylinder 11, that with their gripper tips, bent at right angles, they hold lateral edges 52 and 53 of the second or trailing half 47 of the signatures 42 on the surface of the folding flap cylinder 11 in the area 48 adjacent the rear edge 51. This means that the gripper tips of the pivotable lateral grippers 49 are moved in a curved manner in the axial plane of the folding flap cylinder 11. These lateral grippers 49 can be actuated, for example, by means of curved rings, not shown, fixed on the side frames, as disclosed in German Patent 536 459, FIGS. 3 and 4. Instead of the use of the trailing end grippers 23 which are shown in FIG. 2, the top view shown in FIG. 3, which is the view taken in the direction of arrow D shown in FIG. 2, depicts the use of grippers 49 gripping from the side panels of the folding flap cylinder 11 instead of the grippers 23 which are shown in FIG. 2.

It is also possible, in accordance with the present invention, and for the purpose of adjusting the linear format of the signatures, to dispose the folding flaps 21 fixedly in the folding flap cylinder 11 and to arrange the holding devices 23 or 49 of the folding flap cylinder 11 to be adjustable in or in opposition to the direction of rotation A of the folding flap cylinder 11. The pivotable grippers 49 can also be alternatively disposed in place of the grippers 23 in the channel or groove portion 25 of the support 22 that is pivotably disposed on the shaft 18.

The shape, such as, for example the radius of the product guide device 26 can be changeable. In addition, it is possible that the distance of the product guide device 26 from the outlet wedge, or from the imagined plane 41 between the axes of rotation of the shafts 12 and 18 of the collecting cylinder 9 and the folding flap cylinder 11, is adjustable. By means of this adjustment it is possible to affect or set the path, or in other words the detour of the starting area 43 of the first leading half 44, over the product guide device 26 to the folding flap cylinder 11.

While a preferred embodiment of a method and apparatus for cross-folding signatures in accordance with the present invention has been set forth fully and completely hereinabove, it will be apparent to one of skill in the art that a number of changes in, for example, the overall sizes of the cylinders, the type of rotary printing device being used, the drive assemblies for the various conveyors and the like may be made without departing from the true spirit and scope of the present invention which is accordingly to be limited only by the following claims.

What is claimed is:

1. A method of cross-folding signatures in a folding apparatus of a rotary printing press including the steps of:

providing a collecting cylinder having a plurality of signature receiving fields with each of said receiving fields having only a signature leading edge gripper and a folding blade;

providing a folding flap cylinder having a plurality of folding fields with each of said folding fields having only a signature trailing edge gripper and a folding flap;

positioning said collecting cylinder and said folding flap cylinder in cooperative engagement at a contact point defined by an intersection of a line connecting the axes of rotation of said collecting and folding flap cylinders and a tangent line;

securing only a leading edge of a first half of a signature to said collecting cylinder using one of said signature leading edge grippers;

resting a trailing edge of a second half of said signature on a jacket surface of said collecting cylinder;

rotating said collecting cylinder and inserting a central portion of said signature into one of said folding flaps using one of said folding blades;

rotating said collecting and folding flap cylinders until said trailing edge of said signature is in the vicinity of said contact point;

gripping said trailing edge of said signature with one of said trailing edge grippers on said folding flap cylinder;

subsequently releasing said leading edge of said signature from said signature leading edge gripper on said collecting cylinder as said signature leading edge is travelling at a speed of essentially zero;

allowing said signature leading and trailing edges to become approximately overlapping on said folding flap cylinder; and releasing said trailing edge of said signatures from said trailing edge grippers on said folding flap cylinder.

2. The method of cross-folding signatures in accordance with claim 1 including gripping said trailing edge of said signature with said trailing edge gripper at said contact point between said collecting cylinder and said folding flap cylinder.

3. The method of cross-folding signatures in accordance with claim 1 including gripping said trailing edge of said signature with said trailing edge gripper after said contact point between said collecting cylinder and said folding flap cylinder.

4. The method of cross-folding signatures in accordance with claim 1 including gripping said trailing edge of said signature with said trailing edge gripper before said contact point between said collecting cylinder and said folding flap cylinder.

5. The method of cross-folding signatures in accordance with claim 1 further including releasing said leading edge of said signatures from said leading edge grippers on said collecting cylinder after completely penetrating said folding blade into said folding flap.

6. The method of cross-folding signatures in accordance with claim 1 further including gripping said trailing edge of said signature in the vicinity of a rear edge portion of said signature.

7. The method of cross-folding signatures in accordance with claim 1 further including gripping said trailing edge of said signature in the vicinity of a lateral edge portion of said signature.

8. An apparatus for cross-folding signatures in a folding apparatus of a rotary printing press comprising:

a collecting cylinder having a plurality of signatures receiving fields, each of said receiving fields including only a signature leading end gripper and a folding blade and being adapted to grip only a leading end of a signature with a trailing end of a signature resting ungripped on a surface of said collecting cylinder; and a folding flap cylinder having a plurality of folding fields, each of said folding fields including only a signature receiving folding flap and a signature trailing end holding device, said collecting cylinder and said folding flap cylinder being in engagement at a contact point, each of said trailing end holding devices being located behind, in a direction of rotation of said folding flap cylinder, a corresponding one of said folding flaps a distance generally equal to one half of a length of a signature to be cross-folded, each of said signature trailing end holding devices being operable to grip a trailing end of a signature resting on said surface of said collecting cylinder when said signature trailing end holding device is in the vicinity of said contact point.

9. The cross-folding apparatus of claim 8 wherein each of said signature trailing end holding devices is a controllable gripper.

10. The cross-folding apparatus of claim 9 wherein said controllable grippers engage a rear edge of a trailing half of a signature.

11. The cross-folding apparatus of claim 9 wherein said controllable grippers engage a lateral edge of a trailing half of a signature.

12. The cross-folding apparatus of claim 8 wherein said folding flaps and said holding devices are adjustable on said folding flap cylinder toward and away from each other.

13. The cross-folding apparatus of claim 12 wherein said folding flap cylinder includes first and second star shaped supports disposed in said folding flap cylinder and further wherein said supports are shiftable with respect to each other on a central shaft of said folding flap cylinder, said first and second star shaped supports carrying said folding flaps and said signature trailing end holding devices.

* * * * *